United States Patent [19]

Gustason

[11] Patent Number: 5,057,675

[45] Date of Patent: Oct. 15, 1991

[54] PATCH CORD LENGTH CALCULATOR

[75] Inventor: Robert J. Gustason, Rosemount, Minn.

[73] Assignee: ADC Telecommunications, Inc., Minneapolis, Minn.

[21] Appl. No.: 575,175

[22] Filed: Aug. 30, 1990

[51] Int. Cl.[5] ..... G06G 1/00; G06G 1/02

[52] U.S. Cl. ..... 235/70 A; 235/78 R

[58] Field of Search ..... 235/77, 78 F, 70 A, 235/83, 87 R, 88 F, 78 N, 88 N, 78 R, 70 R, 70 C, 84, 88 R, 74, 87 A

[56] References Cited

U.S. PATENT DOCUMENTS 2,103,332 12/1937 Mayfield ..... 235/84

2,486,913 11/1949 Bessiere ..... 235/70 R 4,028,529 6/1977 Van De Weghe ..... 235/70 A

*Primary Examiner*—L. T. Hix

*Assistant Examiner*—Eddie C. Lee

*Attorney, Agent, or Firm*—Merchant, Gould, Smith, Edell, Welter & Schmidt

[57] ABSTRACT

A hand operated calculator is provided for estimating a length of a patch cord necessary to extend between any two of a plurality of connection locations of spaced apart frames in a distribution bay. The calculator includes three members which are movable relative to one another. Each of the members carries various indicia which when aligned indicate an optimum amount of patch cord necessary to extend between indicated connection locations of spaced apart frames.

4 Claims, 3 Drawing Sheets

PATCH CORD LENGTH CALCULATOR

I. BACKGROUND OF THE INVENTION

1. Field of the Invention

This invention pertains to hand operated calculators. More particularly, this invention pertains to a calculator for use in calculating a length of a patch cord necessary to extend between two locations in an optical fiber distribution bay.

2. Description of the Prior Art

The increased use of optical fiber transmission in the telecommunications industry has resulted in a need for the development of optical fiber termination equipment. An example of such equipment is found in commonly assigned and co-pending U.S. patent application Ser. No. 07/388,060 filed July 31, 1989 which discloses an optical fiber distribution frame. A plurality of distribution frames (i.e., a bay) are shown in side-by-side relation. Each of the frames includes a vertical array of modular cabinets which may include an optical fiber connector module. Disposed between the sides of each of the frames are vertical pathways for optical fiber cables. Also, troughs are provided along the bottom edge of each of the frames. The troughs of adjacent frames are aligned to define a horizontal cable pathway which is in communication with the vertical cable pathways.

In the aforementioned application, when it is desirable to connect a connector module of one frame with a connector module of another frame, an optical fiber patch cord is used. The patch cord has one end connected to the first optical fiber connector module (the "originating module") and the patch cord is then extended down the vertical pathway until it reaches the horizontal trough. The patch cord is then extended horizontally along the horizontal trough until it is fed vertically up the vertical pathway near the other module (the "terminating module"). Accordingly, the length of patch cord necessary to connect an originating and a terminating connector module has a length which is the subject of several variables including: the vertical location of the originating module, the vertical location of the terminating module, and the horizontal distance between the frames which contain two modules.

Commercially available optical fiber patch cord is commonly provided by manufacturers and distributors in fixed lengths. For example, ADC Telecommunications, Inc., Minneapolis, MN (assignee of the present invention) provides patch cords (designated "T-Series") of various predetermined lengths. These could include 115 inches, 123 inches, 131 inches and 139 inches (referred to as 11T, 12T, 13T and 14T, respectively).

It is desirable to provide a quick and ready way for a user of a patch cord to calculate the optimum length of patch cord necessary to extend between an originating and terminating connector module where the vertical locations of the modules and the numbers of troughs separating the frames carrying the two modules is variable. Such is an object of the present invention.

II. SUMMARY OF THE INVENTION

According to a preferred embodiment of the present invention, a hand operated calculator for estimating the length of patch cord is provided. The calculator calculates the length of patch cord necessary to extend between any two of a plurality of locations of adjacent frames. The calculator has a first member which includes a first and second plurality of indicia identifying connection locations on at least two frames. The calculator also includes a second member having a third plurality of indicia which identifies an amount of separation between the two frames. The second member is movable relative to the first member. An alignment means is provided for aligning any desired one of the third indicia with an alignment location on the first member. A fourth plurality of indicia is provided movable with the second member and identifying a length of patch cord. A third member is provided connected to the first and second members and movable relative thereto. The third member has a fifth indicia disposed to be aligned with desired ones of the first and second plurality. The first through fifth indicia and the alignment means are selected to cooperate for the fifth indicia to align with a particular one of the fourth indicia indicating a length of patch cord necessary to extend between two locations on frames separated by known separation when the known separation is aligned with said alignment means and when the fifth indicia is aligned with said first and second indicia which indicate said desired locations.

III. BRIEF DESCRIPTION OF THE DRAWINGS

FIG. 4 is a view taken along line 4—4 of FIG. 3.

IV. DESCRIPTION OF THE PREFERRED EMBODIMENT

Figure 1:
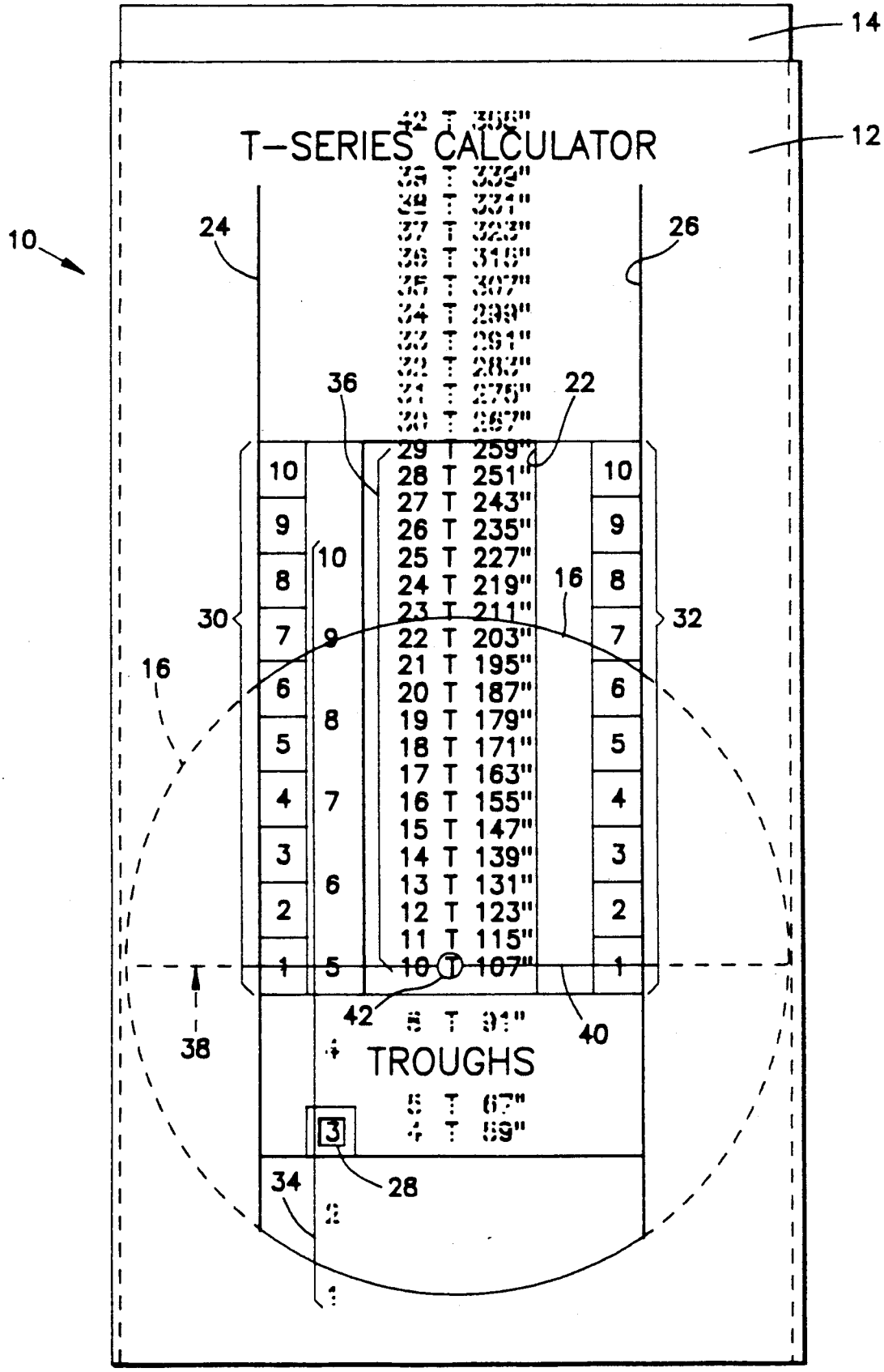
FIG. 1 is a top plan view of a calculator according to the present invention with first, second and third members shown in first positions.

Referring now to the several drawing figures in which identical elements are numbered identically throughout, a description of the preferred embodiment of the present invention will now be provided. A calculator 10 is shown for calculating an amount of patch cord necessary to extend between two connector locations in a fiber distribution bay. In a preferred embodiment, the bay will include a plurality of side-by-side frames such as those shown and described in co-pending and commonly assigned U.S. patent application Ser. No. 07/388,060 filed July 31, 1989. Each of the frames is a vertical column of modules which may include connector locations in the form of connector modules. The frames are separated by vertical cable pathways. The base of the frames include aligned troughs which define a horizontal pathway.

A connector module can be disposed in any of the vertical locations within a frame. When it is desired to extend a patch cord from a first connector location (referred to as an "originating connector module") to a second connector location (referred to as a "terminating connector module") in a different frame, it is necessary to connect a patch cord to the originating module, extend the patch cord down a vertical pathway to the horizontal trough and further extend the patch cord along the horizontal trough to the vertical pathway adjacent the frame which carries the terminating module. The patch cord is extended up the vertical pathway and connected to the terminating module. As a result, the amount of patch cord necessary is dependent upon the vertical position of the originating and terminating modules as well as the number of troughs separating the frames which carry the originating and terminating modules.

The calculator 10 of the present invention readily calculates the amount of patch cord necessary to extend between an originating and terminating connector module. The calculator 10 includes first, second and third members 12, 14 and 16, respectively.

First member 12 is an envelope having a solid back wall 18 and a top wall 20 opposing back wall 18. A rectangular window 22 is cut into top wall 20 to expose the interior of first member 12. A pair of parallel spaced apart slits 24, 26 are cut into top wall 20 and extend on opposite sides of window 22. A square cut out 28 is formed through top wall 20 to provide an alignment means as will be described.

Figure 2:
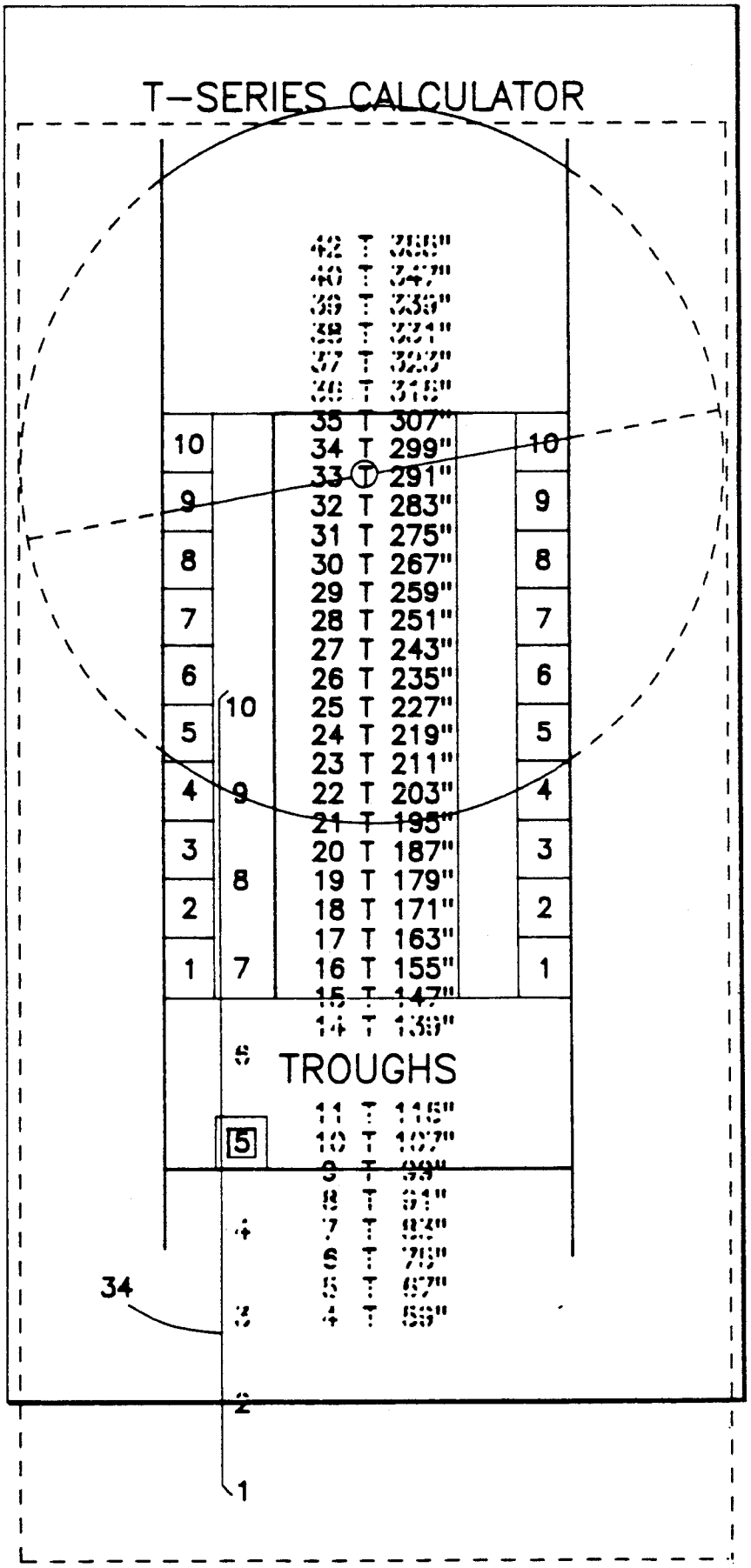
FIG. 2 is the view of FIG. 1 with the members shown in a second position.
Figure 3:
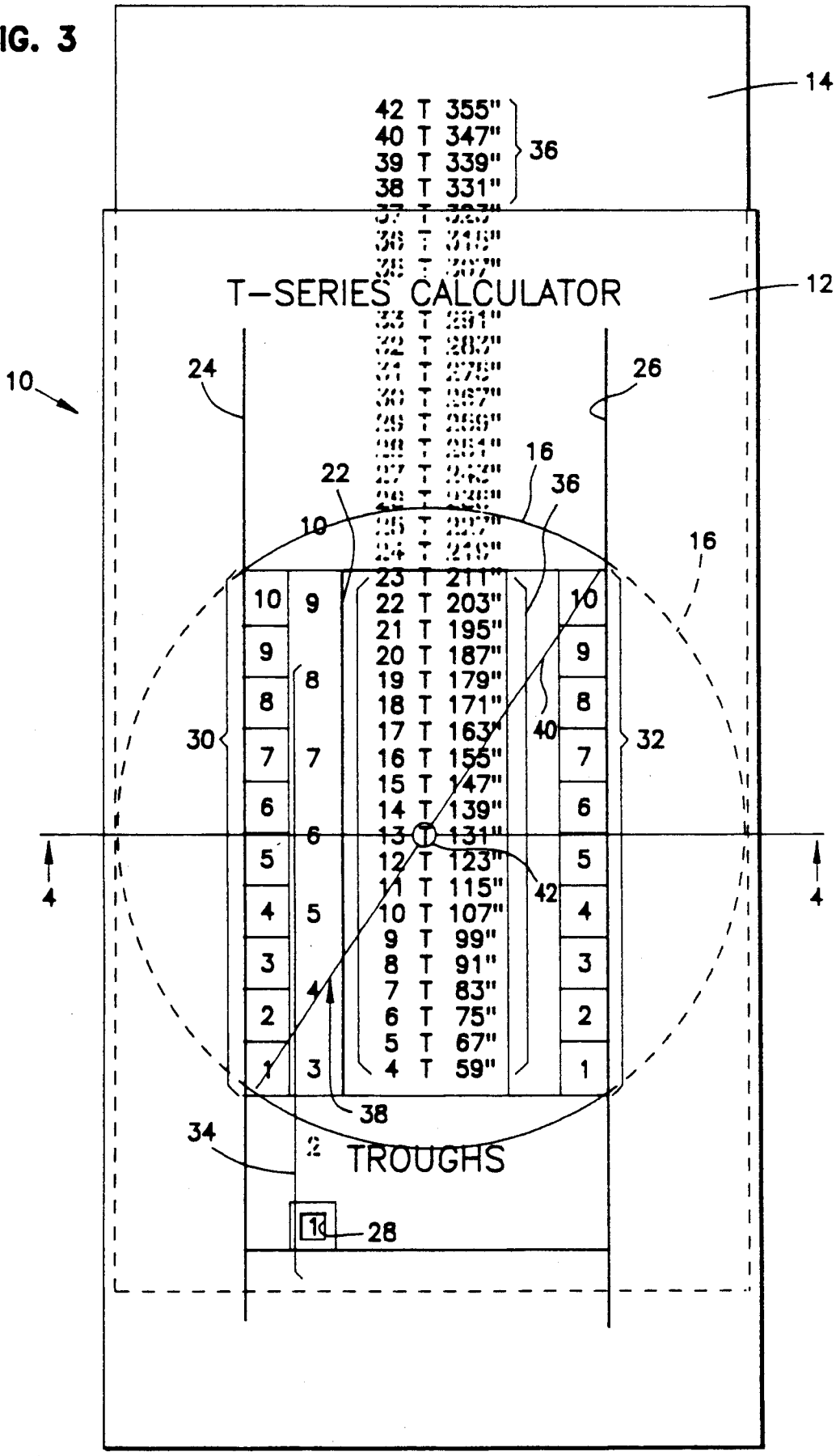
FIG. 3 is the view of FIGS. 1 and 2 with the first, second and third members shown in a third position.

Second member 14 is in the form of a rectangular card sized to be received and slidably retained within first member 12. Accordingly, a portion of card 14 is exposed through window 22 and cut out 28 as card 14 slides within envelope 12. FIGS. 1–3 show three different slidable positions of card 14 within envelope 12.

Third member 16 is a transparent disk which is sized to be received within slits 24, 26 such that disk 16 may be slid along the length of slits 24, 26 as well as being freely rotatable about the central axis of disk 16.

First member 12 carries a first and second plurality of indicia 30, 32. The first plurality of indicia 30 identify vertical locations on a first fiber distribution frame. Likewise, the second plurality of indicia 32 also identify vertical locations on a second fiber distribution frame. The vertical locations are identified by numbers 1–10 indicating ten possible vertically disposed locations on a frame to which a patch cord may be connected.

The second member 14 carries a third and fourth plurality of indicia 34, 36, respectively. The third plurality 34 represents the distance between frames on which a patch cord is to be terminated. In a preferred embodiment, the distance is reflect as the number of troughs separating the frames which carry the connector locations. The third plurality 34 is disposed to be covered by top wall 20 and be exposed to view only through cut out 28. Only a particular one of the third plurality 34 is exposed through cut out 28 as card 14 is slid within envelope 12.

The fourth plurality 36 represents a length of patch cord. In the preferred embodiment, the fourth plurality 36 is indicated as a distance measured in inches. Also, the fourth plurality 36 includes a manufacturer's product designation associated with the desired length (for example, designation 15T is a designation of ADC Telecommunications, Inc. for a 147 inch optical fiber patch cord.)

To illustrate that only certain of the third and fourth indicia are exposed at any time, exposed indicia are shown in solid lines and covered indicia are shown in hidden lines.

The third member 16 includes a fifth indicia 38 in the form of a straight line 40 with a centrally disposed circle 42 printed on transparent disk 16. The line 40 may be aligned with any of the locations of indicia 30 and 32 by simply rotating disk 16 or sliding disk 16 within slits 24, 26. The circle 42 is disposed to identify a particular one of indicia 36 by circling its designator.

The first through fifth plurality of indicia, 30, 32, 36, and 38, respectively, are selected for circle 42 to identify an optimum length of patch cord necessary to extend between a desired originating location and terminating location on two spaced apart frames. The identification of the optimum length is made when line 40 is aligned with the first and second plurality 30, 32 which identify the particular vertical locations of the originating and terminating equipment and when the indicia 34 exposed through cut out 28 indicate the horizontal separation between the frames.

By way of example with reference to a frame such as that shown in U.S. patent application Ser. No. 07/388,060 if the originating location is the first (or lowest) location on the first frame and the terminating location is the highest or tenth location on the second frame and when the frames are separated by a signal trough, an operator positions the first, second and third members 12, 14 and 16 as indicated in FIG. 3. Specifically, disk 16 is rotated and slid to a position with line 40 extending between locations 1 and 10 of indicia 30, 32, respectively, and indicia "1" of the plurality 34 is aligned with cut out 28. Circle 42 then indicates to an operator that a desired patch cord length is 131 inches or patch cord 13T of ADC Telecommunications, Inc.

When both the originating and terminating locations are the lowest (or first) locations of two frames separated by three troughs, the operator repositions the first, second and third members 12, 14 and 16 as indicated in FIG. 1. Reading from circle 42, the operator knows that a patch cord length of 107 inches (or ADC designation 10T) is the optimum patch cord length. Additionally, when the originating and terminating locations are the ninth and tenth locations on frames separated on seven troughs, the operator repositions first, second and third members 12, 14 and 16, respectively as indicated in FIG. 2. Circle 42 then indicates that a desired patch cord length is 339 inches (or ADC designation 39T).

From the foregoing detailed description of the present invention, one skilled in the art will note that the specific spacing of the relative indicia 30, 32, 34, 36 and 38 will vary with the physical geometry and dimensions of the distribution frame for which the calculator 10 is intended for use. However, it is well within the skill of the art to modify the relative spacing of the indica so that a separate calculator can be provided for any frame system of predetermined dimensions having vertically disposed connector locations on a frame and where frames are separated by predetermined horizontal spacings. Accordingly, it is intended that the scope of the present invention not be limited to the specific embodiment shown but shall include all modifications and equivalents such as those that might readily occur to one skilled in the art.

What is claimed:

1. A hand held calculator for estimating a length of patch cord necessary to extend between any two of a plurality of known connection locations of spaced apart frames, said calculator comprising:

a first member having a first and second plurality of indicia, said first plurality corresponding with a plurality of connector locations on a first frame and said second plurality corresponding with a plurality of connector locations on said second frame;

a second member having a third plurality of indicia, said third plurality identifying a distance of separation between any two desired frames;

a fourth plurality of indicia identifying a plurality of possible lengths of a patch cord;

connection means for connecting said first member to said second member while providing relative movement between said first and second member;

alignment means for aligning any desired one of said fourth plurality with an alignment position;

a third member connected to said first and second member and moveable relative thereto, said third member having a fifth indicia disposed to be aligned with desired pair of said first and second plurality corresponding with said known connection locations on said spaced apart frames, said fifth indicia further disposed to indicate an individual one of said fourth plurality when said fifth indicia is aligned with said desired pair; and said first through fifth plurality selected and positioned for said fifth indicia to be aligned with a specific one of said fourth indicia indicating an amount of patch cord necessary to extend between said desired known locations when said fifth indica is aligned with said desired pair and when said third indicia is aligned with said alignment position.

2. A calculator according to claim 1 wherein said first member is an envelope, said second member is a sliding card disposed within said envelope and slidable to said envelope and said third member is a rotary disk carried on said envelope.

3. A calculator according to claim 1 wherein said envelope is provided with a window sized to expose at least a portion of said fourth plurality as said card is slid within said envelope, said first and second plurality disposed on said envelope on opposing edges of said window.

4. A calculator according to claim 3 wherein said fifth indicia is a marking disposed on said rotary disk and sized to extend from any one of said first plurality to any one of said second plurality upon rotation and lateral movement of said disk relative to said envelope.

* * * * *